United States Patent [19]

Mallory et al.

[11] 4,245,174

[45] Jan. 13, 1981

[54] DUAL IONIZATION CHAMBER

[75] Inventors: John Mallory; Zbigniew Turlej, both of Toronto, Canada

[73] Assignee: Isotec Industries Limited, Toronto, Canada

[21] Appl. No.: 899,179

[22] Filed: Apr. 24, 1978

[51] Int. Cl.[2] ..... H01J 39/28

[52] U.S. Cl. ..... 313/3; 313/54; 250/384; 340/329

[58] Field of Search ..... 340/628, 629; 250/381, 250/382, 384, 385, 389, 496; 313/54, 3

[56] References Cited

U.S. PATENT DOCUMENTS

| | | | |
|---|---|---|---|
| 1,569,494 | 1/1926 | Hurd | 250/496 |
| 2,646,556 | 7/1953 | Allen | 340/629 X |
| 2,702,898 | 2/1955 | Meili | 340/629 X |
| 2,994,768 | 8/1961 | Derfler | 340/629 X |
| 3,271,756 | 9/1966 | Crawford et al. | 250/385 X |
| 3,295,121 | 12/1966 | Meyer | 340/629 |

FOREIGN PATENT DOCUMENTS

| | | |
|---|---|---|
| 1277091 | 6/1972 | United Kingdom . |
| 1280304 | 7/1972 | United Kingdom . |
| 1299234 | 12/1972 | United Kingdom . |
| 1341372 | 12/1973 | United Kingdom . |
| 1347306 | 2/1974 | United Kingdom . |
| 1379535 | 1/1975 | United Kingdom . |
| 1493509 | 11/1977 | United Kingdom . |

*Primary Examiner*—John W. Caldwell, Sr.
*Assistant Examiner*—Daniel Myer

[57] ABSTRACT

In an electronic smoke sensing and alarm device, a dual ionization chamber arrangement comprises a single source of radioactive material and first and second chambers separated by a common electrically conductive electrode. A portion of the radioactive material ionizes the air in the first chamber and another portion of the radioactive material ionizes the air in the second chamber. This arrangement provides an accurate control on the current flow through each chamber.

9 Claims, 8 Drawing Figures

FIG.1.
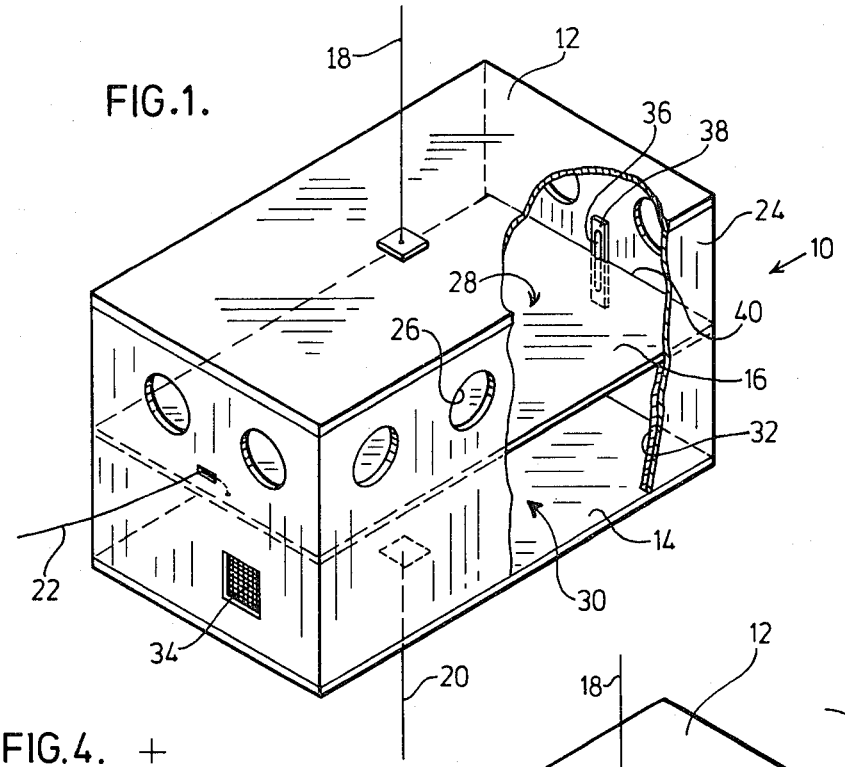
FIG.4.
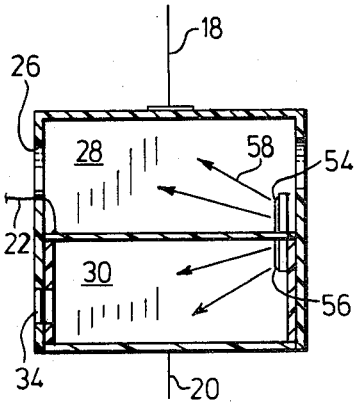
FIG.3.
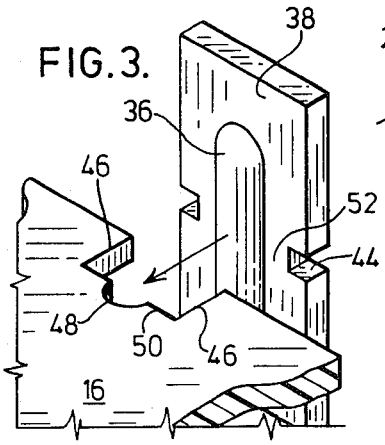
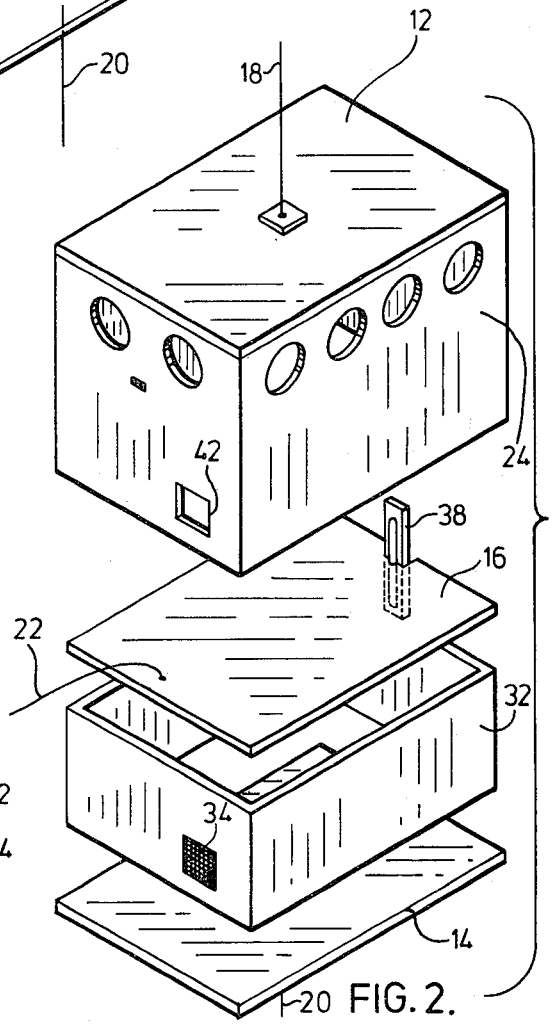
FIG. 2.

DUAL IONIZATION CHAMBER

FIELD OF THE INVENTION

This invention relates to a dual ionization chamber arrangement adapted for use with electronic smoke detection equipment and more particularly to an ionization chamber arrangement which uses a single source of radioactive material, independent portions of which are capable of ionizing the air in the corresponding chambers.

BACKGROUND OF THE INVENTION

It is generally accepted in the art of smoke detection devices that a dual ionization chamber arrangement is most advantageous in detecting smoke particles in the air due to combustion and to readily compensate for gradual ambient changes. The dual ionization chamber is particularly advantageous compared to a single ionization chamber in series with a resister which cannot compensate for ambient changes.

It has been generally accepted, that in order to provide ionized molecules in the dual chambers, a separate and distinct source of radioactive material is positioned in each chamber to ionize the medium and supply the ions. Several hundred or thousands of sources of radioactive material are usually made by die cutting them from large sheets of radioactive material. It has been found that the variation in distribution of radioactive material on such sheets and hence the amount of radioactive material on each die cut source can vary from source to source by as much as $\pm 15\%$. It can therefore be appreciated that in using two separate and distinct sources, there can be a considerable difference in current flow established in two essentially identical smoke detector ionization chambers. This creates a significant problem because this wide range of variation between amounts of radioactive material from source to source requires complex calibration equipment and modifications to the internal electronics to provide an electrically balanced dual ionization chamber arrangement which has a mid-point voltage on the intermediate electrode. The importance of establishing the same current flow in each of the chambers thereby setting a constant midpoint voltage in the dual ionization chamber arrangement, will be discussed in more detail with respect to this invention.

The dual ionization chamber arrangement according to this invention overcomes the above problems in an efficient, economically manufactured manner and readily lends itself to changing the amount of radioactive material in each chamber to achieve a mid-point voltage for chambers of differing electrical characteristics.

SUMMARY OF THE INVENTION

The dual ionization chamber and single source of radioactive material is adapted for use with electronic smoke detector and alarm devices. The single source of radioactive material is adapted to ionize the air in both chambers and provide a more exacting control on the current flow in each chamber. This type of control may be used to establish the same current flow in each chamber thereby providing a mid-point voltage at the intermediate electrode of the dual ionization chamber arrangement. The single source of radioactive material is so arranged in the dual ionization chamber arrangement to provide a portion for ionizing the air in one of the chambers and provide another portion for ionizing the air in the other chamber. By varying the size of the portions of radioactive material in each chamber, changes can be effected in the current flow in each chamber to arrive at a mid-point voltage on the intermediate electrode.

According to an aspect of the invention, it provides dual ionization chambers having first and second ionization regions, separated by a common electrically conductive electrode. A first electrode is associated with the first chamber and is spaced apart from the common electrode. A second electrode is associated with the second chamber and is spaced apart from the common electrode. A single source of radioactive material is provided, a portion of which ionizes the air in the first chamber and another portion of which ionizes the air in the second chamber to establish current flow in each chamber due to the presence of the created ions when a voltage is applied to the first and second electrodes. With proper selection of components and chamber configuration, a mid-point voltage or a voltage approximately one half the applied voltage can be established on the common electrode.

According to another aspect of the invention, the first and second chambers may be separated by a common partition which has associated therewith the common electrode. The single source of radioactive material may have its portions for ionizing the air in the two chambers, isolated from one another by the partition.

The electronic device in combination with the dual ionization chamber arrangement for detecting combustion products is electrically connected to the first, second and intermediate or third electrode, where as mentioned a potential is applied across the first and second electrodes. The first chamber is so arranged to be open or have an opening to allow smoke particles to migrate into the first chamber. The second chamber may be provided with an opening which is adapted to essentially preclude or retard the migration of combustion products thereinto to compensate for ambient changes as is fully appreciated by those skilled in the art of dual ionization chamber technology for smoke detectors. On the entry of combustion products into the first chamber, a portion of the ions are adsorbed on the surfaces of the smoke particles and other combustion products, to upset the balance of voltage drops across the dual ionization chambers and thereby change the voltage level on the intermediate electrode. This change in voltage level is detected by the electronic device and for a predetermined level of combustion products, the detected corresponding change in voltage level sets off an audible alarm.

According to another aspect of the invention, the single source of radioactive material may be in the form of a strip mounted at the end of the common partition in a predetermined manner to isolate the portion sizes of the radioactive material on each side of the partition.

In providing this strip of radioactive material, it may be mounted on a rigid elongate support member. The support member may have locating means for cooperating with the partition to provide an accurate location of each radioactive strip in each dual ionization chamber arrangement for each manufactured unit. This substantially reduces costs of manufacture and provides for easier calibration of the unit once assembled.

DESCRIPTION OF THE DRAWINGS

These and other advantages and features of the invention, will become apparent to those skilled in the art where it is appreciated that according to several aspects of the invention, various configurations for the ionization chambers and arrangements and adaptations for the source of radioactive material may be provided as examplified in preferred embodiments of the invention as shown in the drawings wherein:

FIG. 1 is an isometric view with a portion thereof cutaway to show a dual ionization chamber arrangement with a single source of radioactive material;

FIG. 2 is an exploded view of the dual ionization chamber of FIG. 1;

FIG. 3 is an enlarged view of the strip of radioactive material being located at the end of a common partition for the dual ionization chamber;

FIG. 4 examplifies the single source of radioactive material having separate portions thereof ionizing the air in the respective chambers;

DETAILED DESCRIPTION OF THE PREFERRED EMBODIMENTS OF THE INVENTION

Figure 5:
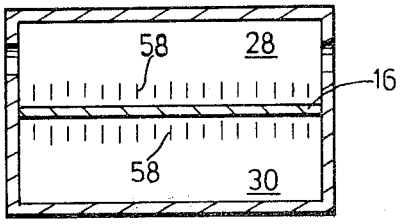
FIG. 5 shows schematically an alternative arrangement in providing a single source of radiation in association with the common partition to radiate the dual chambers.

A preferred mode of assembly is shown in FIG. 1 for the dual ionization chamber arrangement 10 which consists of a first electrically conductive plate 12, a second electrically conductive plate 14 and an intermediate electrically conductive plate 16. In this particular embodiment of the invention, plates 12, 14 and 16 are parallel to one another and are evenly spaced apart. Electrodes 18, 20 and 22 are connected respectively to the first plate 12, second plate 14 and intermediate plate 16. As a standard procedure in dual ionization chambers adapted for use with electronic sensing apparatus, a potential is applied across electrodes 18 and 20 to establish electric fields in the first and second ionization chambers or regions defined between first plate, intermediate plate and second plate.

A sidewall 24 has in its upper section, openings 26 which allow ready migration of combustion products into and out of the first chamber generally designated by arrow 28. The sidewall 24 is of electrically insulating material to insulate the plates from one another. The second chamber generally designated 30 has an opening at 34 with a fine filter material or tortuous path to retard or essentially preclude migration of combustion products into it. It is understood that when it is desired to compensate only for temperature, opening 34 or its equivalent is not required so that chamber 30 may be sealed.

A single source of radioactive material 36 is mounted on a rigid support 38 and is positioned at an end 40 of partition 16. The partition 16 isolates an upper portion of the radioactive material from a lower portion. The so isolated portions of radioactive material ionize the air in the respective first and second chambers 28 and 30. The radioactive material may be any radioactive form which is capable of ionizing molecules in the air. As is well known various types of radioactive material emiting $\alpha$ or $\beta$ radiation can be used. Examples of such radioactive materials are Americium 241, and Nickel-63.

As is appreciated by those skilled in the art, with a balanced condition for first and second chamber arrangements, a mid-point voltage at electrode 22 can be established which is one half of the voltage applied across electrodes 18 and 20. Upon the entry of smoke particles into the first chamber 28, the particles are presumed to adsorb on their surfaces some of the ions in the air and thereby retard their migration from the first plate 12 to the intermediate plate 16 and in turn change the voltage drop across the first chamber. The voltage level on plate 16 is altered by the change in voltage drop across the first chamber because there is no or essentially no combustion products in the second chamber. Assuming that electrode 18 is positive, there would be an increase in voltage drop between plates 12 and 16 to thereby lower the voltage on electrode 22. This change in voltage at electrode 22 is sensed by electronic circuitry commonly used in electronic smoke detectors. The unit may be calibrated so that a voltage change corresponding to a predetermined level of combustion products in the air causes the device to sound an alarm.

Referring to FIG. 2, and exploded view of the arrangement of FIG. 1 illustrates a preferred manner in which the unit may be assembled and manufactured. The first plate 12 may be connected to the insulating sidewall portion 24. The strip of radioactive material on support 38 is mounted on central partition 16. The second plate 14 is connected to an insulating side wall portion 32 having the opening 34 provided therein. These components are telescopically associated and secured to provide the assembled arrangement shown in FIG. 1. An aperture 42 is provided and is coincident with openin 34.

Turning to FIG. 3, the enlarged view shows the mounting of a strip of radioactive material 36 on an elongate rigid support member 38. The support member 38 is provided with notches 44 which are adapted to cooperate with parallel and opposing edges 46 of the recess provided in partition 16. The bottom of the recess has dished portion 48 to accommodate the shape and thickness of the radioactive strip 36. Planar portions 50 abut the planar surfaces 52 of the support 38. The closeness and accuracy of fit may be such that the joint is air tight. However, it is understood that with manufacturing tolerances, openings 34 may be eliminated and instead provide a slight spacing between support 38 and recess walls of partition 16 to allow air movement from the first chamber to the second chamber. The slight spacing would be such to retard or preclude the movement of smoke particles into the second chamber yet maintain a compensation for ambient changes.

As shown in FIG. 4 the source of radioactive material 36 is located at the end 40 of the partition where a first portion 54 is isolated by the partition from a second portion 56. Portion 54 ionizes the air in the first chamber 28 and portion 56 which is independent of the first portion 54 ionizes the air in the second chamber 30.

As previously explained, an accepted method for making sources of radioactive material is to die cut them from a large sheet of radioactive material on a support. In this manner of manufacture, each die cut source of radioactive material has a consistant distribution of radioactive material over its surface. Another known method for making sources of radioactive material is to roll out a layer of material on a length of support strap. The strap is cut transversely to provide strips of radioactive material. With such strips there is a symmetrical distribution of radioactive material to each side of the strip's middle. With either method of making of strip 36, a positioning of partition 16 mid-way of the strip's length isolates portion 54 having an amount of radioactive material equal to that in portion 56. It is understood that in mass production, manufacturing tolerances have to be contended with because it is not economically feasible to position precisely the partition mid-way of strip 36. The variance, however, of the amount of radioactive material in portions 54 and 56 is insignificant to the variance encountered with the prior art arrangements using two separate sources. It is also understood that for any other positioning of strip 36 to compensate for unsymmetrical chamber configuration will have an insignificant variation in desired amounts for portions 54 and 56 for mass production.

The rigid support 38 may be provided with locating means such as the notches 44 which cooperate with opposing edges 46 to provide and locate equal portions 54 and 56 on each side of the partition 16. For an arrangement such as shown in FIG. 4, the single source of radioactive material ensures that for each manufactured unit, there are essentially equal portions of radioactive material in each chamber. Therefore for manufactured units, the consistency in providing the same portions 54 and 56 of radioactive material in each chamber substantially simplifies the calibration of the assembled devices and eliminates the need for difficult judgement calls by the calibrator. This ensures high quality in every manufactured product with the attendant advantages of accuracy in detecting combustion products.

Another advantage in using a single radiation source according to this invention is that should the chamber configurations be different or the presence of metal in one or the other chambers imbalance chamber electric fields, then by changing the size of the portions of the source in each chamber, the current flow in each chamber can be changed to arrive at the desired mid-point voltage at 22. For example, should there by an imbalance in chamber configuration with a greater voltage drop in chamber 28 than in 30, the size of portion 54 can be increased and corresponding the size of portion 56 decreased by locating the mid-point of the source above the partition. Once the position for the source has been established for the particular chamber configuration, the notches 44 can be so located in manufactured support 38 to always ensure that the particular pre-determined size of portions 54 and 56 will always be such to provide the desired mid-point voltage at 22. It is therefore apparent that with this arrangement there is provided a wide range of adjustments to compensate for differences in chamber configuration and an accurate positioning of the source of radioactive material in each manufactured unit.

A further advantage of this invention is that the support for the source of radioactive material may have means which cooperates with the chamber walls or partition to enable one to adjust the strip position relative to the partition. This arrangement is particularly advantageous when it is not desired to calibrate the unit by altering the circuit parameters of the electronic detector. The strip's position can be adjusted by a calibrator to provide the correct sizes of isolated portions of the single strip's radioactive material for the corresponding chambers, to establish the mid-point voltage on the common electrode.

It is apparent that other shapes for the single source of radioactive material 36 may be provided to ionize the air in chambers 28 and 30 in the direction of arrows 58 as long as the partition isolates one portion from the other. It may be found that something other than a strip is the desireable shape, such as hour-glass shape, triangle, circle, FIG. 8 etc. to provide the desired portion of radioactive material for each chamber.

On the basis of the concept of the invention exemplified in the preferred embodiment of FIG. 1 it can also be appreciated that other locations for the source of radioactive material may be used. With the arrangement shown schematically in FIG. 5, the partition 16 may be made up of a radioactive substance such as Nickel-63 which is adapted to ionize the air in chambers 28 and 30 from both sides in directions of arrows 58. It is of course apparent that there is a single source of radioactive material adapted so that independent portions thereof ionize the air in the corresponding chambers.

Figure 6:
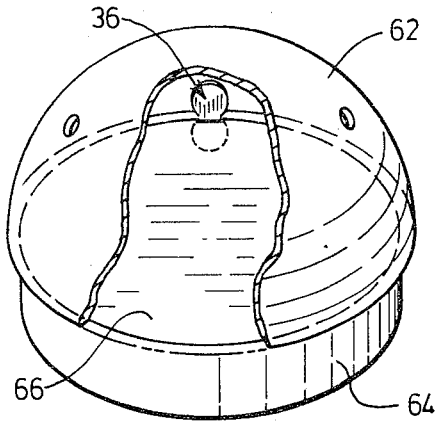
FIGS. 6, 7 and 8 show alternative chamber configurations for dual ionization chambers having a single source of radioactive material.

It is also understood from the concept of the invention set out in the embodiment of FIG. 1 that other chamber configurations may be used. FIG. 6 shows another type of chamber configuration where the first chamber is defined within the cylinderical underlying wall 64. The first and second chambers are separated by partition 66, the periphery of which serves to electrically insulate an electrically conductive dome 62 from electrically conductive base plate portion of second chamber defined within cylinder 64. The single source of radioactive material 36 is in the shape of "FIG. 8" where the upper portion is isolated from the lower portion by the edge of partition 66. In this manner, the first and second chambers are exposed to portions of radioactive material, the amounts of which are predetermined so as to provide the desired mid-point voltage on partition 66. It is understood that electrodes would be electrically connected to the dome 62, the base plate portion of cylinder 64 and partition 66.

Figure 7:
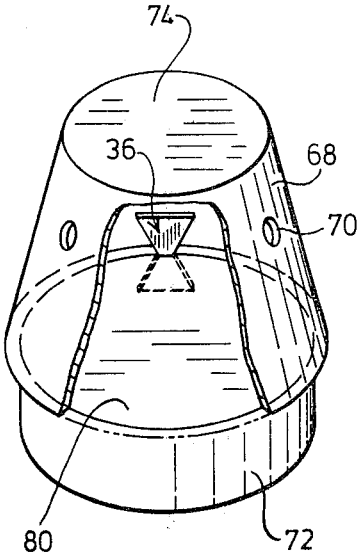

An alternative configuration for the chambers is shown in FIG. 7 where a truncated cone portion 68 forms a first chamber. The cone 68 has in its sidewall, openings 70 to permit migration of combustion products into and out of the first chamber. The second chamber is defined within the cylinderical base portion 72 which has electrically conductive plate portion at its base. The upper part of truncated cone 68 designated at 74 may be the electrically conductive plate of the first chamber. The first and second chambers are isolated by a partition 30. Mounted within the dual ionization chamber arrangement, is the source of radiation 36 which is of an hour glass shape. The partition 80 isolates the portions of radioactive material. The predetermined amounts of radioactive material for the first and second chambers is established in this arrangement by proper location of the source 36 at the edge of the partition 80.

Figure 8:
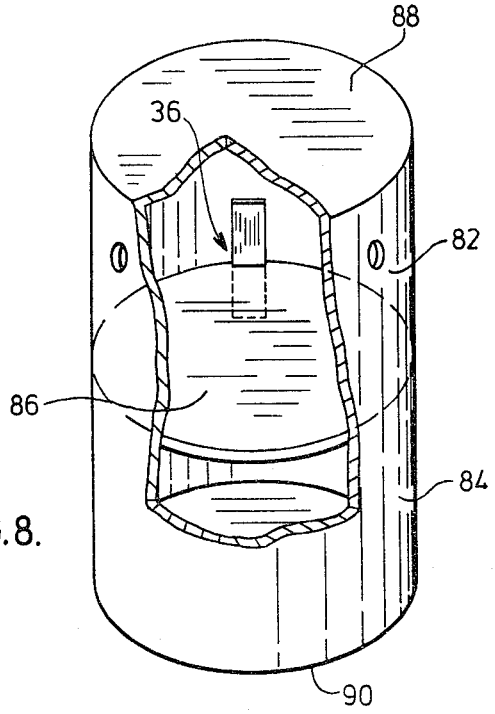

A further chamber configuration is shown in FIG. 8. It consists of a hollow cylinder of insulating material having upper portion 82 and lower portion 84 divided by a moveable partition 86. The upper portion 82 functions as the first chamber and the lower portion 84 functions as the second chamber. The second electrically conductive plates 88 and 90 are at the ends of the cylinder. Partition 86 isolates portions of the source of radioactive material 36 in a manner to provide the predetermined sizes of radioactive material for the first and second chambers. The partition may be moved by the calibrator to establish the mid-point voltage on the partition.

The dual ionization chamber arrangement according to this invention provides a high degree of flexibility in manufacture, yet accuracy in determining the amount of radioactive material in each chamber to substantially improve or facilitate calibration of the unit, improve it's reliability and substantially reduce costs of manufacture.

Although the preferred embodiments of the invention have been described in detail, it will be apparent to those skilled in the art, that variations may be made thereto without departing from the spirit of the invention, or the scope of the appended claims.

The embodiments of an invention in which an exclusive property of privilege is claimed are defined as follows:

1. Dual ionization chambers adapted for use with an electronic smoke detection device comprising first and second chambers separated by a common electrically conductive partition and a single source of radioactive material provided on one side of a support having locating means associated therewith and adapted to cooperate with said partition to accurately and positively locate said source of radioactive material with a first portion which ionizes the air in said first chamber and a second portion which ionizes the air in said second chamber independently of the first portion.

2. Dual ionization chambers of claim 1 (amended) wherein said partition isolates said first portion, of radioactive material from said second portion such portions of radioactive material independently ionizing the air in the respective chambers.

3. Dual ionization chambers of claim 2 (amended) wherein said partition has a portion of said radioactive source on one side and another portion on the other side to thereby independently radiate the respective chambers.

4. Dual ionization chambers of claim 1 (amended) wherein said single source of radioactive material is in the form of a strip said common electrode isolating said portions of radioactive material.

5. Dual ionization chambers of claim 4 wherein said strip of radioactive material is mounted at an end of said partition to isolate said portions of radioactive material.

6. Dual ionization chambers of claim 1 (amended), wherein first and second electrodes are electrically conductive plates, and said partition being positioned said first and second electrodes, the first and second electrode plates being equally spaced apart from and parallel to the partition.

7. Dual ionization chambers of claim 6 (amended) said source of radioactive material being positioned at an end of said partition to thereby isolate a first portion thereof for ionizing the air in said first chamber from a second portion thereof for ionizing the air said second chamber independently of the first.

8. Dual ionization chambers of claim 6 (amended) said source of radioactive material being a strip positioned on said support, an end of said partition having a recess adapted to accommodate said strip and support, said support having locating means for cooperating with said partition to locate said support in said recess and for accurately providing said first and second portions of radioactive material.

9. Dual ionization chambers of claim 8 (amended) said first and second portions of the single one-sided source of radioactive material being essentially equal in size.

* * * * *